United States Patent [19]

Fukushima et al.

[11] Patent Number: 4,664,502

[45] Date of Patent: May 12, 1987

[54] LIQUID DEVELOPING APPARATUS FOR USE IN ELECTROPHOTOGRAPHIC COPYING MACHINE

[75] Inventors: Masao Fukushima, Echi; Iwao Hirose; Yoshio Miyauchi, both of Hikone, all of Japan

[73] Assignee: Dainippon Screen Mfg. Co., Ltd., Japan

[21] Appl. No.: 736,798

[22] Filed: May 22, 1985

[30] Foreign Application Priority Data

Jun. 27, 1984 [JP] Japan ..... 59-133606

[51] Int. Cl.[4] ..... G03G 15/10

[52] U.S. Cl. ..... 355/10; 118/660; 354/317

[58] Field of Search ..... 355/3 R, 10; 354/317, 354/320, 321; 118/659, 660, 661

[56] References Cited

U.S. PATENT DOCUMENTS

| | | | |
|---|---|---|---|
| 3,547,076 | 12/1970 | Saklikar | 118/637 |
| 3,753,393 | 8/1973 | Niesen et al. | 355/10 X |
| 3,791,345 | 2/1974 | McCutcheon | 118/637 |
| 3,929,099 | 12/1975 | Szymber et al. | 355/10 X |
| 4,114,999 | 9/1978 | Kogiso et al. | 355/10 |
| 4,133,292 | 1/1979 | Takasugi et al. | 118/650 |
| 4,576,467 | 3/1986 | Yamasaki et al. | 355/10 |

FOREIGN PATENT DOCUMENTS

| | | |
|---|---|---|
| 49-62148 | 6/1974 | Japan . |
| 56-14525 | 4/1981 | Japan . |
| 58-116709 | 6/1983 | Japan . |

*Primary Examiner*—Fred L. Braun

*Attorney, Agent, or Firm*—Brumbaugh, Graves, Donohue & Raymond

[57] ABSTRACT

Apparatus for an electrostatic copying machine using a liquid developer or toner includes a pair of electrodes for developing the latent image on the electrostatically charged photosensitive sheet, of which the auxiliary or back electrode has a specially grooved surface such that the contact area with the sheet is smaller at the front and rear ends of the auxiliary electrode than at the central portion. In one embodiment, the grooves comprise two series of uniformly spaced identical circular arcs, the two series having opposite curvatures for intersection and defining the contact areas.

2 Claims, 5 Drawing Figures

LIQUID DEVELOPING APPARATUS FOR USE IN ELECTROPHOTOGRAPHIC COPYING MACHINE

BACKGROUND OF THE INVENTION

This invention relates to a wet developing apparatus used in electrophotographic copying machine for the development of electrostatic latent images using a liquid developer.

For the development of electrostatic latent image (hereinafter called as "latent image") formed on a electrophotographic photosensitive sheet (hereinafter called as "photosensitive sheet") using a liquid developing apparatus for electrophotographic copying machine, it is generally recognized that the following requirements are indispensable to obtain a clear and sharp reproduced image:

(I) The photosensitive sheet is permitted to come nearer to a developing electrode;

(II) Even and adequate development is obtained on the surface of a latent image;

(III) Back side of the latent image is free from any stain by toner;

(IV) The photosensitive sheet is assured of smooth advance.

With respect to the foregoing requirements, it is usually understood that following points are to be taken into consideration:

(a) When the developing electrode comes nearer to the photosensitive sheet, a resolving power is increased, a high density being obtainable, and a halo, i.e., an edge effect peculiar to the electrophotography being decreased;

(b) To obtain even and adequate developing density, it is required not to produce a variation in the local electric characteristics (resistance, for example) caused by inadequate or non-uniformed spacing between the electrodes or by the partial stain, and also required to feed the developing solution uniformly and sufficiently onto the surface of the photosensitive sheet;

(c) To prevent the back side of the photosensitive sheet from being stained by toner and to avoid disordered electric charge on the photosensitive sheet, the back side shall not be put in contact with an auxiliary electrode plate;

(d) To ensure smooth advance of the photosensitive sheet, a guide of low frictional resistance is required.

A number of attempts have been proposed to meet the above-discussed requirements (a), (b), (c) and (d) at a time. Indeed that each of those proposals has its own advantage, but that the requirements for the fair reproduction (a reproduced image of high density, noiseless and high contrast, for example) and for the prevention of the back side from being stained have not been satisfactorily met yet.

According to one example disclosed in Japanese Patent Application laid open under Provisional Publication (unexamined) No. Sho 49-62148, in order to meet the foregoing requirements (I) through (IV), a developing solution is applied to both sides of the photosensitive sheet, a nylon thread having larger electric resistance than that of the developing solution is stretched facing to the auxiliary electrode plate, and the photosensitive sheet is positioned using the nylon thread as a guide. According to said apparatus, as the photosensitive sheet is immersed or bathed in the developing solution, the enforcement to be operated to the toner becomes less or reduced, and thus the characteristics proper to the toner and those of the latent image are appropriately represented as it is. As the result thereof, a relatively successful density, contrast, etc. are obtained and the stain on the back side is not so much. According to said apparatus, however, in order to make a rapid progress of the development, it is necessary to accelerate the polarization in the developing solution thereby the external effect of the electric field of the latent image being increased. Thus it will be essential to use a developer of lower resistance, as the result of which edges of the image are disordered inviting such disadvantages as sagging of edge, mal-reproduction of details. Furthermore, the back side is not completely free from stain because of the existence of gut or nylon thread, and in particular the back side of blackened part is easy to be stained. Besides, in case of using said apparatus over relatively longer period (several weeks), the toner sticks to the contact area between the gut and the auxiliary electrode plate, and it becomes necessary to carry out periodical maintenance service such as cleaning of the auxiliary electrode plate, which is a troublesome work.

According to another example disclosed in Japanese Utility Model Application published under Publication (examined) No. Sho 56-14525, an apparatus is proposed having electroconductive meshes stretched opposite to the auxiliary electrode plate as a guide as well as for positioning, and making use of so-called an effect of electro-conductive mesh. According to an experiment, however, it is found that said effect of electro-conductive mesh has following disadvantages:

(i) When the developing solution is not fed flowing through the back side of the photosensitive sheet, it is difficult to obtain an adequate developing density;

(ii) Back side stain cannot be prevented even by using a fine mesh of about #300, for example;

(iii) Toner sticks to the meshes during the period of repeated uses and the sticked toner can hardly be removed when dried. Particularly at the first copying on each day, the back side is stained by local uneveness of image density and by the physical contact. Furthermore it is quite troublesome to periodically clean the elector-conductive meshes placed on the auxiliary electrode plate.

According to a further example published by U.S. Pat. No. 3,547,076, which makes use of so-called Al effect of electrical field, the developing density is increased by voltage elements which push away the toner to the side of latent image, and the toner sticked to the non image area on the surface of the photosensitive sheet causing a noise on the back side thereof can be removed or separated therefrom by the voltage elements of reversed polarity. Said apparatus, however, can perform such advantage in a quite limited circumstance or only when the photosensitive sheet applied thereto has an electro-conductive backing of which resistance is sufficiently low. Accordingly, either in case of some photosensitive sheet without such electro-conductive backing and necessary to be charged by means of corona discharge or in case of the other photosensitive sheet of high resistance, the impressed AC electrical field not only increases the developing density on the image surface but also accelerates the sticking of toner to the back side of the latent image, resulting in considerable stain thereof.

In view of the above-discussed disadvantages, the applicant has proposed a liquid developing apparatus satisfying the aforementioned requirements (I) to (IV)

as is disclosed in Japanese Patent Application No. Sho. 58-116709.

To be more specific, the applicant disclosed a liquid developing apparatus used for electrophotography comprising a passage for feeding developing solution which is formed between a main electrode plate and an auxiliary electrode plate facing to each other so that a photosensitive sheet having an electrostatic latent image therein is developed in said passage, wherein at least a surface of said auxiliary electrode plate facing to the back side of the photosensitive sheet is formed into a roughened surface.

Even in case of such improved apparatus, there exists a problem of wear and tear described hereunder.

SUMMARY OF THE INVENTION

An object of this invention is to provide a novel liquid developing apparatus satisfying the above-described requirements at a time and of which structure and advantageous features are different from the apparatus disclosed in the prior application.

In order to accomplish the foregoing object, there is provided a liquid developing apparatus comprising a passage for feeding developing solution which is formed between a main electrode plate and an auxiliary electrode plate facing to each other so that a photosensitive material having an electrostatic latent image is developed in said passage, characterized by that grooves are formed at least on the auxiliary electrode plate of said electrode plates so that the area in contact with said photosensitive material is variable with respect to the direction of carrying the photosensitive material.

By the liquid developing apparatus wherein at least the auxiliary electrode plate is constructed as mentioned above, the contact resistance between the photosensitive material and the auxiliary electrode plate is minimized when the former is carried through the passage, and since the groove of the auxiliary electrode plate serves for easy flow down of the developing solution, even and smooth developing is feasible.

Furthermore, since a uniform point contact is achieved mainly at the part where back side of the photosensitive material comes in contact with the front end and the rear end of the auxiliary electrode plate, an excellent quality of image having high density is obtained at the contact area of the photosensitive material in practical use.

Other objects of the present invention will appear in the course of the following description with the accompanying drawings.

BRIEF DESCRIPTION OF THE DRAWINGS

In the accompanying drawings forming a part of this application, and in which like parts are designated reference numerals throughout the same.

DESCRIPTION OF THE PREFERRED EMBODIMENTS

Referring now to the accompanying drawings, some of the preferred embodiments of the liquid developing apparatus is described in detail hereinafter.

Figure 1:
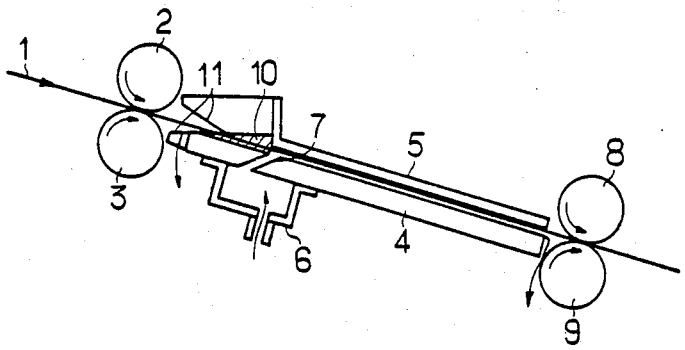
FIG. 1 is a sectional side elevation illustrating a preferred embodiment of a liquid developing apparatus in accordance with this invention.
Figure 3:
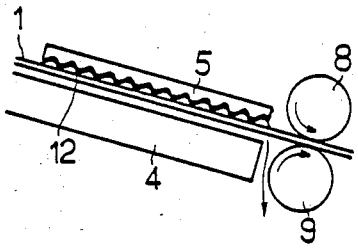
FIG. 3 is an partially enlarged view of FIG. 1.

In FIGS. 1 and 3, a photosensitive sheet 1 is fed in the direction of arrow by feed rollers 2, 3 and is carried into a developing solution passage formed between a main electrode plate 4 provided with some inclination and an auxiliary electrode plate 5 provided facing to the main electrode plate 4. In this process, before feeding the photosensitive sheet 1, the developing solution is forcedly injected to said passage as an uniform and rectified flow out of a delivery opening or slit-like outlet 7 formed across the carrier way of said photosensitive sheet through the developing solution feeder by means of a pump (not illustrated), and then the developing solution, after filling the passage therewith, being accumulated in a solution sump 10. The photosensitive sheet 1 is carried through the passage with its latent image side facing to the main electrode plate 4 (with said image side downward), and then carried in the direction of arrow by the feed rollers 2, 3. The head part or introduction end of the photosensitive sheet 1 is advanced at first to said sump 10 by a guide 11 and then to said passage. In this process, the photosensitive sheet 1 is pushed up to the side of the auxiliary electrode plate 5 by the developing solution injected out of the slit-like opening 7, thus being carried along with the auxiliary electrode plate 5.

Figure 2:
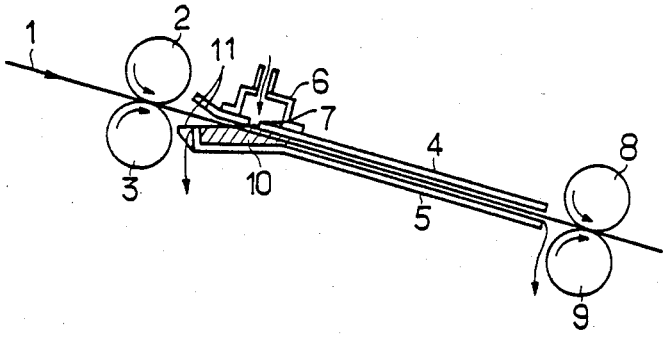
FIG. 2 is a sectional side elevation illustrating another embodiment of a liquid developing apparatus in accordance with this invention.

The developing solution accumulated in said sump 10 flows naturally through between the back side of the photosensitive sheet 1 and the auxiliary electrode plate 5. In this connection, in case of the developing apparatus disclosed in said Japanese Patent Application No. Sho. 58-116709, since an irregular surface 12 coated with fluororesin film including electro-conductive component is formed on the surface of said auxiliary electrode plate 5 as shown in FIG. 3, the developing solution flowing naturally performs an effect of liquid bearing reducing almost to zero the frictional resistance between the irregular surface 12 and the back side of the photosensitive sheet 1, thereby smooth advance of the photosensitive sheet being accelerated. Meanwhile, the latent image of the photosensitive sheet 1 comes to be a visible image by the toner included in the developing solution forcedly injected, and is delivered out of the developing apparatus by rollers 8, 9. The function and the operation of another embodiment shown in FIG. 2 are almost the same as the foregoing first embodiment, although this another embodiment is used when the photosensitive sheet 1 is carried with its latent image side upward.

However, when carrying out actually the development using the auxiliary electrode plate 5 having the irregular surface 12 coated with fluororesin film, although the developing solution flows down naturally between the photosensitive material 1 and the auxiliary electrode plate 5, the coated film on the projecting portion of the irregular surface 12 comes to gradually wear out through the repeated contacts of the back side of the photosensitive material 1 with the irregular surface 12, thereby bringing about the disadvantage of producing uneven development in rather short period depending upon the photosensitive material 1.

In view of the foregoing, as a result of the various experiments and studies repeatedly carried out, the applicant comes to obtain a liquid developing apparatus without uneven development in which a large number of grooves are provided on the side of the developing solution passage by such working method as direct planning, milling, pressing, fabrication, chemical etching, electrolytic oxidation, etc. thereby said side being roughened, and when forming said roughened surface, said grooves are so disposed that the area being in contact with the back side of the photosensitive material is variable with respect to the direction of flowing down of the photosensitive material.

Figure 4:
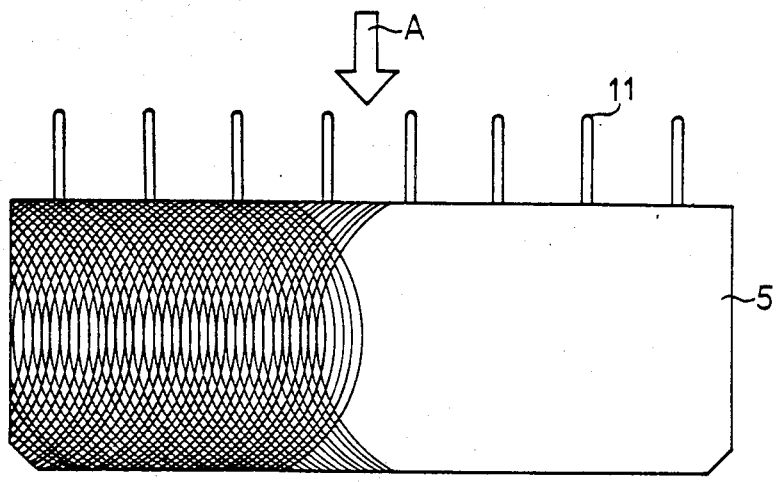
FIG. 4 is a plan view of an auxiliary electrode plate used in the liquid developing apparatus of this invention.
Figure 5:
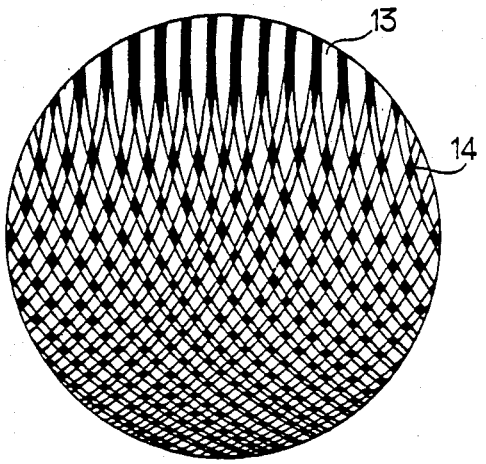
FIG. 5 is a partially enlarged view of FIG. 4.

FIG. 4 shows a state of forming grooves on the auxiliary electrode plate 5 as one mode of this invention, and FIG. 5 is a partially enlarged view thereof. In these FIGS. 4 and 5, the large number of grooves 13 are provided forming circular arcs by displacing each center sequentially at a certain pitch, and, by additionally providing further grooves in reverse direction, the area of the projecting portions 14 which come in contact with the back side of the photosensitive material 1 and the distribution thereof in the direction downstream of the developing solution indicated by the arrow A (FIG. 4), i.e., in the direction of carrying the photosensitive material 1, in other words, the total contact area is varied.

In this embodiment, for example, each groove of 0.7 mm in width is successively provided forming each circular arc of 300 mmϕ in diameter by displacing the center at a certain pitch of 0.15~0.20 mm and further grooves are provided in reverse direction. In this formation of grooves, the area in contact with the back side of the photosensitive material 1 is considerably reduced in comparison with the case wherein the grooves are uniformly roughened by oblique crossing forming a checker pattern on condition that the width and the pitch of the groove 13 is same. In this connection, the sectional shape of the groove 13 is not limited to a specified one and semicircular, V-shaped, U-shaped, rectangular or other groove is possible as a matter of course.

In the liquid developing apparatus constructed as shown in FIGS. 1 and 2, it is a general tendency that the back side of the photosensitive material 1 comes in close contact with the front end and the rear end of the auxiliary electrode plate 5, while not so close contact with the center part of the auxiliary electrode plate 5. Accordingly, even when the projecting portion 14 having a relatively large contact area is formed at the center part as shown in the embodiment of FIGS. 4 and 5, it does not cause the uneven development on the photosensitive material 1.

In effect, the characteristic of the liquid developing apparatus in accordance with this invention exists in that the area of each contact point at the front end and the rear end of the auxiliary electrode plate is reduced with respect to the carrying direction of the photosensitive material by providing grooves on the developing solution passage side of the auxiliary electrode plate.

In this connection, it is also possible to provide the aforementioned grooves on the main electrode plate, although the grooves are provided on the auxiliary electrode plate in the foregoing embodiment. In such structure, a turbulent flow is formed near around the main electrode plate by the irregularities when the developing solution flows down, thereby the contact of the photosensitive material being sufficiently prevented.

It is to be understood that this invention is not limited in its application to the details of construction and arrangement of parts illustrated in the accompanying drawings, since this invention is capable of other embodiments and of being practiced or carried out in various ways. Also it is to be understood that the phraselogy or terminology employed herein is for the purpose of description and not of limitation.

We claim:

1. An apparatus for developing a latent electrostatic image on a photosensitive sheet by contact with a liquid developer, comprising a main electrode and an auxiliary electrode disposed face to face for forming a common passageway for the developer of which at least the auxiliary electrode includes on its face a plurality of grooves for defining projecting portions for contact with the sheet characterized in that the projecting portions form smaller contact areas at the upstream and downstream portions of the passageway than at the intermediate portion.

2. The apparatus of claim 1 further characterized in that the grooves form two series of uniformly spaced identical circular arcs, each arc extending between the upstream and downstream ends of the passageway, the arcs of each series having opposite curvatures.

* * * * *